US009597539B2

(12) United States Patent
Grider

(10) Patent No.: US 9,597,539 B2
(45) Date of Patent: Mar. 21, 2017

(54) MOVEABLE BAR CATCH WITH SUPPORT

(71) Applicant: TuffStuff Fitness Equipment, Inc., Chino, CA (US)

(72) Inventor: Sherman P. Grider, Chino, CA (US)

( * ) Notice: Subject to any disclaimer, the term of this patent is extended or adjusted under 35 U.S.C. 154(b) by 565 days.

(21) Appl. No.: 13/743,326

(22) Filed: Jan. 16, 2013

(65) Prior Publication Data

US 2014/0200117 A1 Jul. 17, 2014

(51) Int. Cl.
*A63B 21/078* (2006.01)
*A63B 21/00* (2006.01)
*A63B 17/04* (2006.01)

(52) U.S. Cl.
CPC ..... *A63B 21/00047* (2013.01); *A63B 17/04* (2013.01); *A63B 21/078* (2013.01); *A63B 2225/093* (2013.01)

(58) Field of Classification Search
CPC ..... A63B 21/078; A63B 21/0783; A63B 21/0786; A63B 71/0054; A63B 71/0081
USPC ..... 482/104, 94, 97
See application file for complete search history.

(56) References Cited

U.S. PATENT DOCUMENTS 4,286,782 A * 9/1981 Fuhrhop ..... A63B 21/078 482/103
4,700,944 A 10/1987 Sterba et al.
5,727,764 A 3/1998 Angeles
D444,827 S 7/2001 Mobley
6,347,777 B1 2/2002 Webber et al.
6,447,433 B1 9/2002 Reyes
6,551,226 B1 4/2003 Webber et al.
6,685,601 B1 2/2004 Knapp
6,746,379 B1 6/2004 Brawner
7,131,937 B2 11/2006 Skilken et al.
7,338,416 B2 3/2008 Smith
8,337,370 B2 * 12/2012 Rogers ..... A63B 21/078 482/104

* cited by examiner

*Primary Examiner* — Loan H Thanh
*Assistant Examiner* — Rae Fischer
(74) *Attorney, Agent, or Firm* — TDFOSTER; Bruce Hare; Thomas D. Foster

(57) ABSTRACT

A gym system is described. The gym system includes multiple vertical support members, each support member comprising a set of locking receptacles, and a moveable bar catch having a tubular body adapted to slide along at least one vertical support member, and a pivoting locking feature comprising a protuberance adapted to engage a particular locking receptacle from among the set of locking receptacles. A bar catch including a tubular body adapted to be able to be positioned along a support member of a weightlifting support apparatus is also described. The bar catch includes a solid hook adapted to support a weightlifting bar and to pivot at one end, allowing the solid hook to be placed in a moveable first position and a locked second position, a safety support adapted to provide support to the solid hook and the weightlifting bar, and a handle coupled to the tubular body.

8 Claims, 6 Drawing Sheets

MOVEABLE BAR CATCH WITH SUPPORT

BACKGROUND

Home gyms are ubiquitous in society. Many users of such gyms may want to perform various different types of exercises using equipment that does not take up a significant amount of floor space. In addition, commercial establishments may also wish to include compact multi-purpose systems. Users may thus want to be able to quickly manipulate various features of the equipment to facilitate various exercises or routines.

In addition, many users may use significant weights that require substantial support (e.g., some systems may allow a user to "self-spot", requiring bar catches to support a significant load in order to protect a user from injury).

Thus there is a need for a solution that allows users to quickly and easily move from one position to another using moveable bar catches while also providing significant structural support.

BRIEF SUMMARY

An exemplary embodiment of the invention provides a gym system that includes multiple vertical support members, each support member having a set of locking receptacles, and a moveable bar catch that includes a tubular body adapted to slide along at least one vertical support member, and a pivoting locking feature comprising a protuberance adapted to engage a particular locking receptacle from among the set of locking receptacles.

An alternative exemplary embodiment of the invention provides a bar catch for a weightlifting support apparatus. The bar catch includes a tubular body adapted to be able to be positioned along a support member of the weightlifting support apparatus, a solid hook adapted to support a weightlifting bar, the solid hook further adapted to pivot at one end, allowing the solid hook to be placed in a first position which allows the tubular body to move along the support member and a second position that prevents the tubular body from moving along the support member, a safety support adapted to provide support to the solid hook and the weightlifting bar, and a handle coupled to the tubular body.

Another alternative exemplary embodiment of the invention provides a method of positioning a weightlifting bar catch. The method includes providing a moveable support feature, providing a pivot locking feature associated with the moveable support, allowing the moveable support to be positioned along a vertical support member if the pivot locking feature is placed in a first position, and securing the moveable support along the vertical member if the pivot locking feature is placed in a second position.

The preceding Summary is intended to serve as a brief introduction to some embodiments of the invention. It is not meant to be an introduction or overview of all inventive subject matter disclosed in this document. The Detailed Description that follows and the Drawings (or "Figures" or "FIGs.") that are referred to in the Detailed Description will further describe the embodiments described in the Summary as well as other embodiments. Accordingly, to understand all the embodiments described by this document, a full review of the Summary, Detailed Description and the Drawings is needed. Moreover, the claimed subject matter is not to be limited by the illustrative details in the Summary, Detailed Description and the Drawings, but rather is to be defined by the appended claims, because the claimed subject matter may be embodied in other specific forms without departing from the spirit of the invention.

BRIEF DESCRIPTION OF THE DRAWINGS

The novel features of the invention are set forth in the appended claims. However, for purpose of explanation, several embodiments of the invention are set forth in the following drawings.

DETAILED DESCRIPTION

In the following detailed description of the invention, numerous details, examples, and embodiments of the invention are set forth and described. However, it will be clear and apparent to one skilled in the art that the invention is not limited to the embodiments set forth and that the invention may be practiced without some of the specific details and examples discussed.

Figure 1:
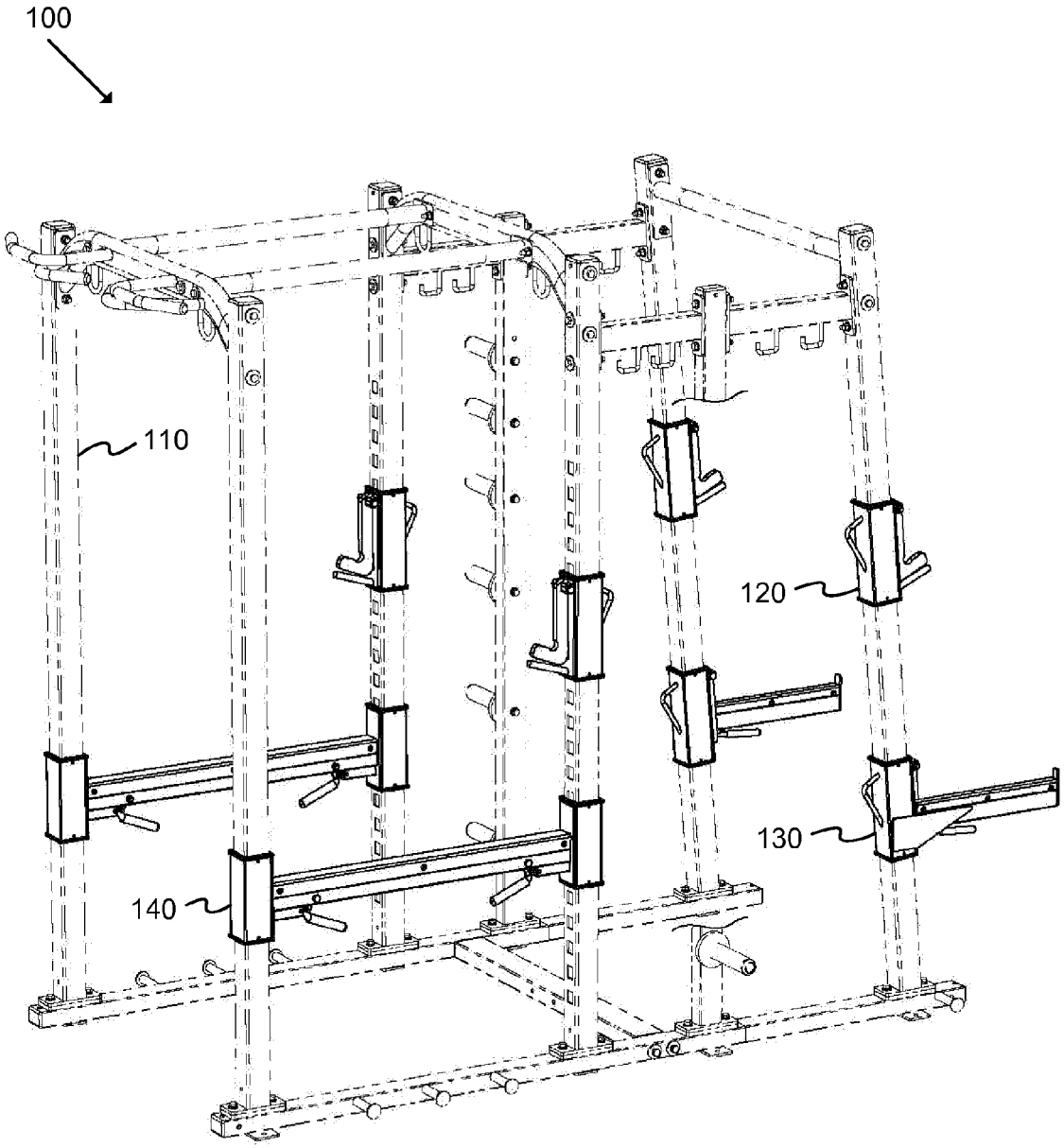
FIG. 1 illustrates a perspective view of an exercise system according to an exemplary embodiment the invention.

FIG. 1 illustrates a perspective view of an exercise system 100 according to an exemplary embodiment the invention. Specifically, this illustration shows various support components that may be included in the system. As shown, the system includes a support structure that includes one or more vertical members 110, a first type of bar catch 120, a second type of bar catch 130, and a third type of bar catch 140.

Each vertical member 110 may be appropriately sized and shaped for each particular system 100. In this example, the vertical members 110 are square members formed from rigid metal (and/or other appropriate materials). Different embodiments may include differently shaped (e.g., round, square, rectangular, oval, etc.) vertical members. Such members may be sized differently (and/or different thicknesses of and/or types of materials may be chosen) based on the loads expected to be supported by the members (and/or other components of the system).

The first type of bar catch 120 may be positioned along a vertical member at various locations. The bar catch may include various elements that may be used during different exercise routines (and/or when positioning the bar catch). The first type of bar catch may allow a user to place a weightlifting bar onto a pair of bar catches such that the weightlifting bar is supported by the bar catches (e.g., at the beginning or end of a set of exercises). The first type bar catch will be described in more detail in reference to FIGS. 3-8 below.

The second type of bar catch 130 may include an extended horizontal support element. Such a bar catch may allow a user to self-spot, whereby the second type of bar catch is placed at a location that allows the user to release a weight-lifting bar such that the bar will be supported by the horizontal support elements and the user will not be injured by the bar (and weights attached to the bar). Such a bar catch may be positioned along the vertical members 110 as described below in reference to FIG. 8.

The third type of bar catch 140 may include a horizontal support member that extends between a pair of attachment elements. Each attachment element may be positioned along the vertical members 110 as described below in reference to FIG. 8. Such a bar catch 140 may provide significant support, such as when a user is manipulating significant amounts of weight.

Figure 2:
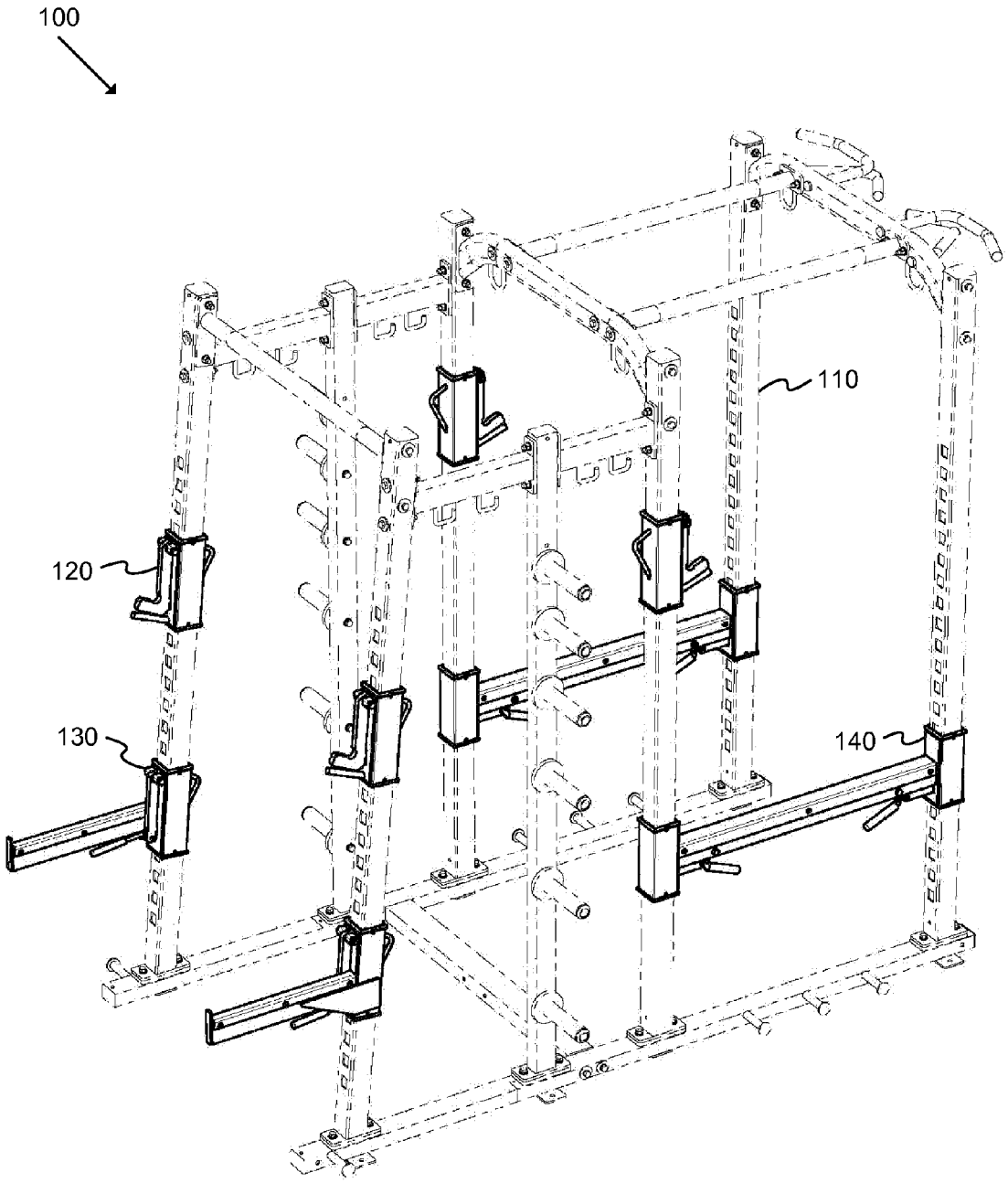
FIG. 2 illustrates an alternative perspective view of the exercise system of FIG. 1.

FIG. 2 illustrates an alternative perspective view of the exercise system 100.

One of ordinary skill in the art will recognize that system 100 may be implemented in various different ways without departing from the spirit of the invention. For instance, although the system is shown as having particular components (and numbers of each component), different systems may include different types (and/or numbers) of components. As another example, although the various supports are shown as attaching to vertical members, some embodiments may include moveable elements that attach to horizontal support members, as appropriate.

Figure 3:
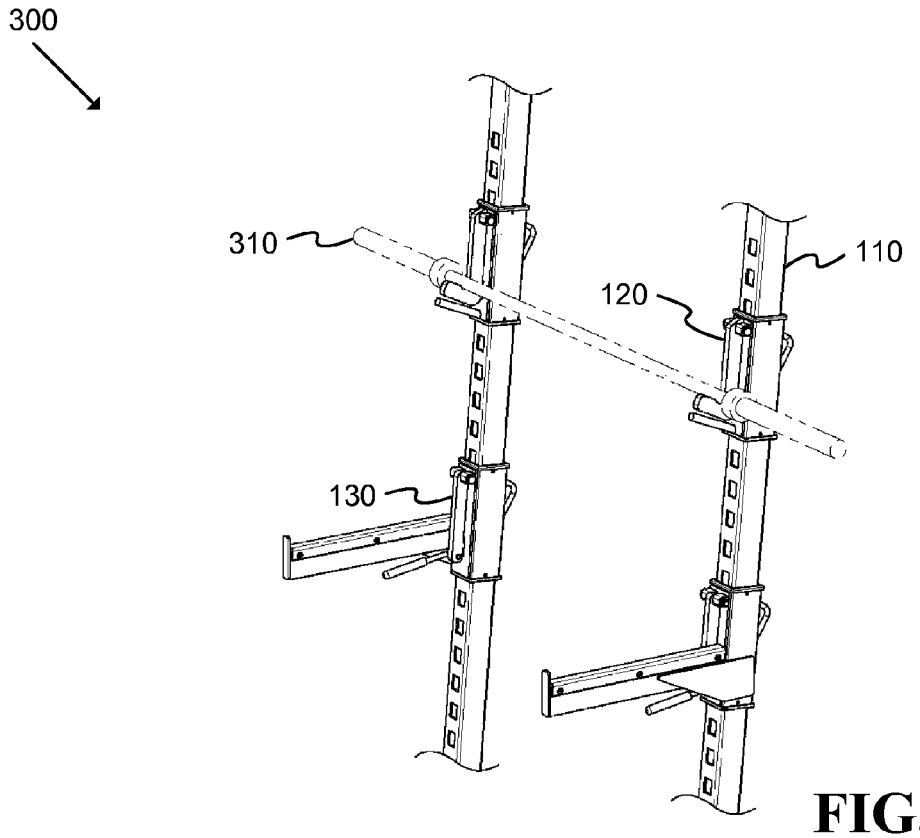
FIG. 3 illustrates a perspective view of a portion of the system of FIG. 1 in use.

FIG. 3 illustrates a perspective view of a portion 300 of system 100 in use. As shown, a pair of bar catches 120 is being used to support a bar 310. In addition, a pair of horizontal support catches 130 are positioned below the bar catches 120.

Figure 4:
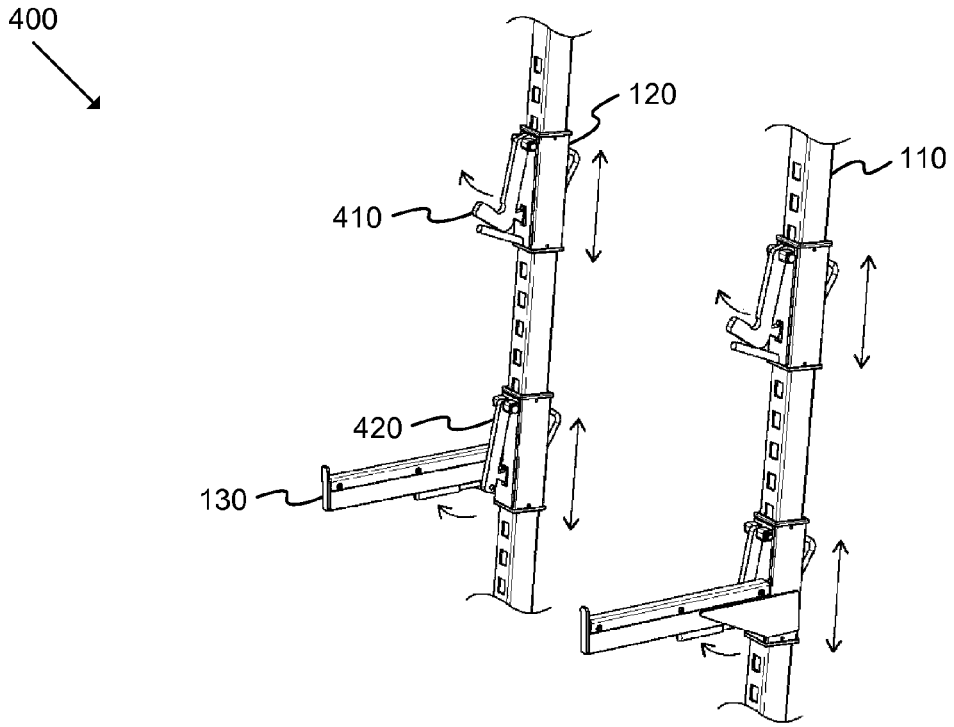
FIG. 4 illustrates a perspective view of a portion of system, highlighting the moveable bar catches of some embodiments.

FIG. 4 illustrates a perspective view of a portion 400 of system 100, highlighting the moveable bar catches of some embodiments. As shown, the first type of bar catch 120 may include a moveable support hook 410 that may be positioned in such a way as to allow the body of the catch 120 to slide along a vertical support member 110. Likewise, the second type of bar catch 130 may include a moveable element 420 that may be positioned so as to allow the body of the catch 130 to slide along a vertical support member 110. The third type of bar catch 140 may include a similar moveable element (not shown) to allow the bar catch to slide along each of a pair of vertical support members.

Figure 5:
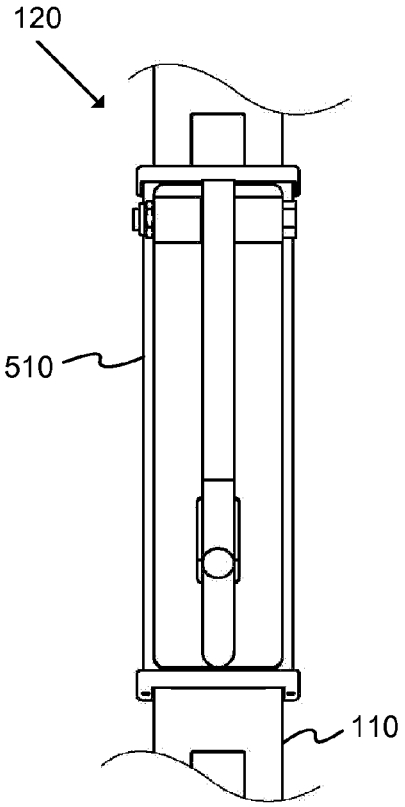
FIG. 5 illustrates a front view of a bar catch provided by some embodiments of the system of FIG. 1.

FIG. 5 illustrates a front view of a bar catch 120 provided by some embodiments of system 100. As shown, the bar catch 120 may include a tubular body 510 that is sized to allow the body (and thus the bar catch) to slide along a vertical member 110.

Figure 6:
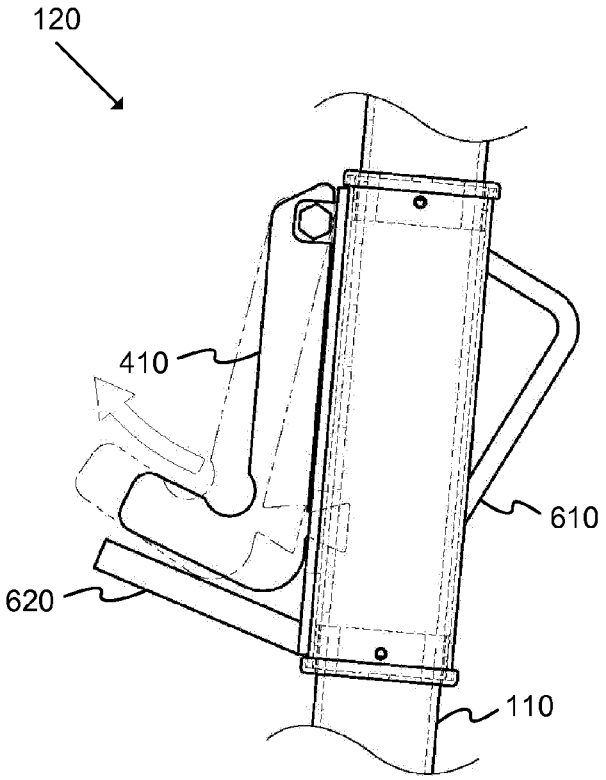
FIG. 6 illustrates a side view of the bar catch of FIG. 5.

FIG. 6 illustrates a side view of bar catch 120. As shown, the bar catch may include a moving hook 410, a handle 610 that may be used when positioning the catch, and a support element 620 that may serve as protection in case the moving hook 410 is unable to support a load placed on the bar catch 120.

Figure 7:
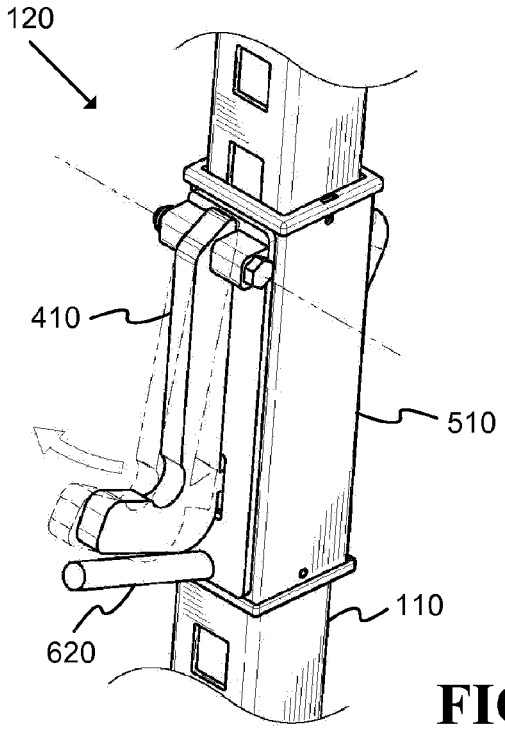
FIG. 7 illustrates a perspective view of the bar catch of FIG. 5.

FIG. 7 illustrates a perspective view of bar catch 120, highlighting the pivoting motion of the moving hook 410.

Figure 8:
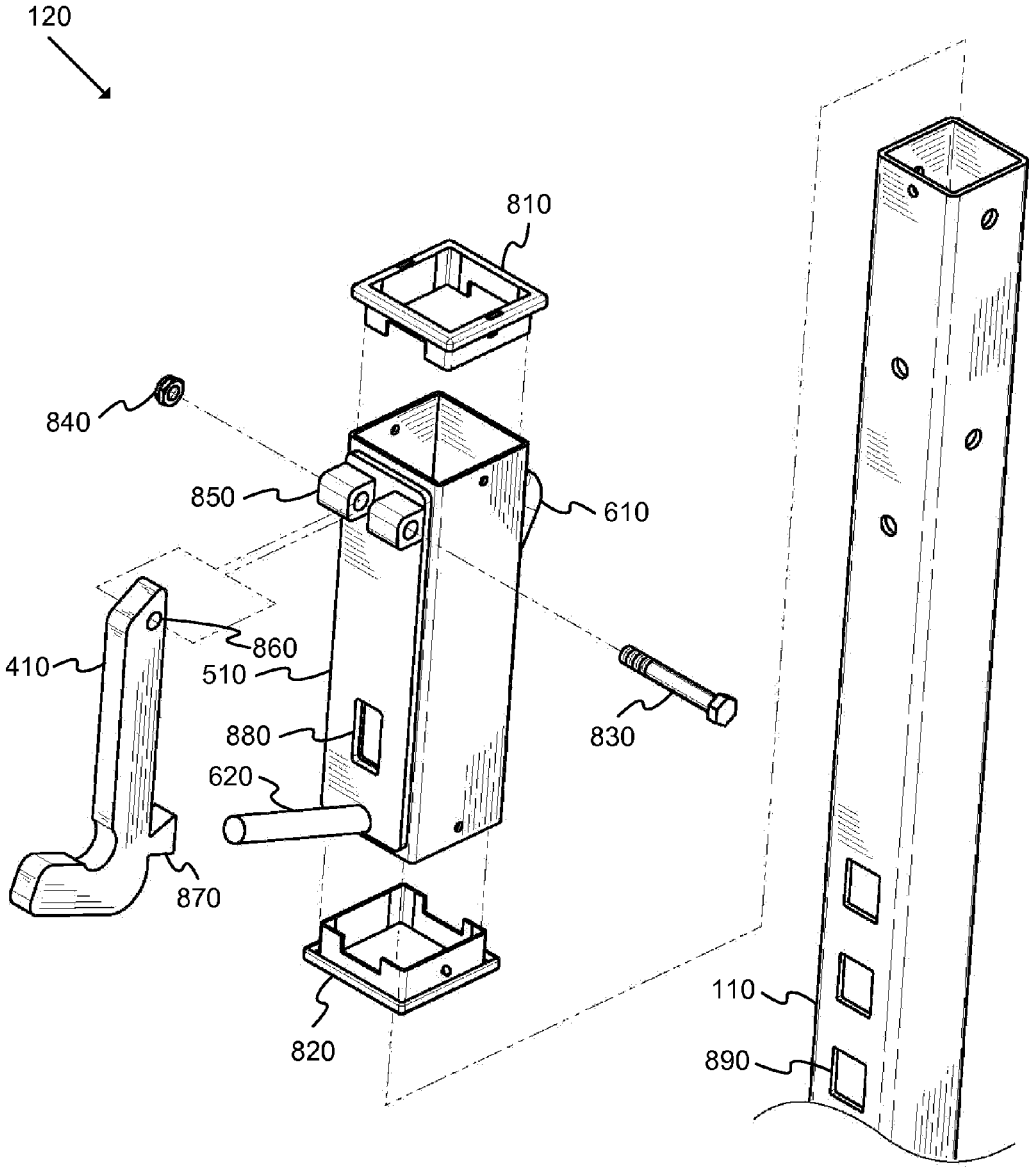
FIG. 8 illustrates an exploded view of the bar catch of FIG. 5.

FIG. 8 illustrates an exploded view of bar catch 120. Bar catches 130-140 may be implemented in similar ways. As shown, the bar catch 120 may include a top cap 810, a bottom cap 820, a pivot bolt 830, a pivot nut 840, at least one pivot bolt support 850, a pivot bolt receptacle 860, a locking protuberance 870, and a through hole 880. In addition, as shown, the vertical member 110 may include a set of spaced through holes 890.

The top cap 810 may fit onto the body 510 of the bar catch 120 and may allow the catch to slide freely along a vertical member 110. The bottom cap 820 may similarly fit onto the body 510 of the bar catch 120 and may allow the catch to slide freely along a vertical member 110. Such caps may be made of various appropriate materials (e.g., plastic, metal, etc.) that may allow the bar catch to move along a support member.

The pivot bolt 830 may be an appropriately-sized tubular element that may allow rotation about an axis. The pivot bolt may be made of various appropriate materials (e.g., metal) and may be sized in various appropriate ways. For example, the radius of the cylindrical portion of the bolt may be sized differently depending on the expected range of loads to be supported. The pivot nut 840 may attach to the pivot bolt in order to lock the bolt 830 in place. The pivot nut 840 may be made of various appropriate materials (e.g., metal) and may be sized and threaded to fit the pivot bolt 830.

Each pivot bolt support 850 may be coupled to the body 510 of the bar catch 120 (e.g., by welding, forging the support as part of the catch, etc.). Such supports 850 may be sized and/or shaped appropriately for the pivot bolt 830, pivoting hook 410, weight to be supported, etc.

The pivot bolt receptacle 860 may be a through hole that is sized to accept the cylindrical portion of the bolt 830. Thus, the pivoting hook 410 may be able to pivot about an axis defined by the centerline running along the length of bolt 830.

The locking protuberance 870 may be adapted to fit through the through hole 880 and one of the through holes 890. Thus, during operation, the pivoting hook 410 may be moved away from the body 510 of the catch 120, disengaging the protuberance 870 from the through holes 880-890. The body 510 of the catch 120 may then be moved along the vertical member 110 to an alternative position, at which point the protuberance 870 may be engaged with the through holes 880-890 to lock the bar catch 120 in place. Each through hole 880-890 may be of various appropriate shapes and sizes (e.g., square) and may be adapted to fit a locking feature of a bar catch.

Although various features of a bar catch of some embodiments have been described above with reference to a particular type of bar catch (e.g., bar catch 120), one of ordinary skill in the art will recognize that such features may be used with other types of bar catches, as appropriate (e.g., bar catches 130-140).

Figure 9:
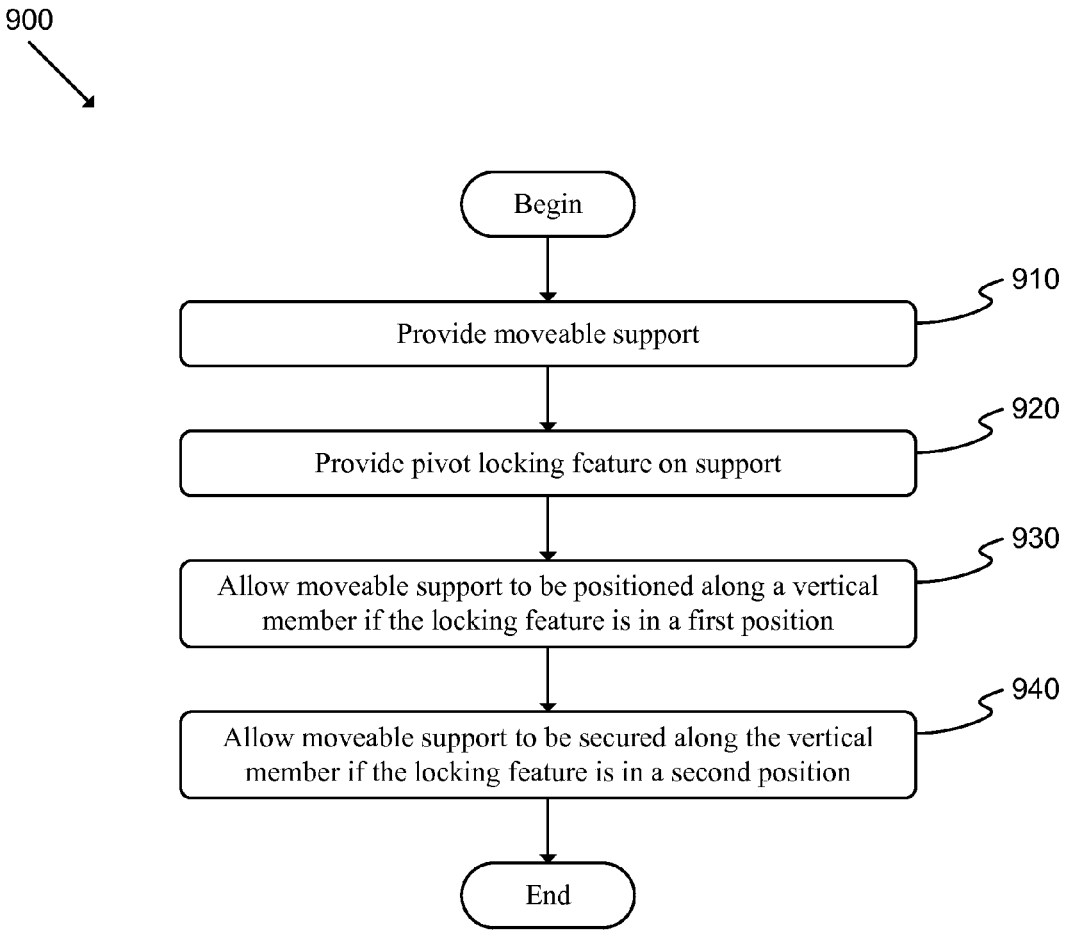
FIG. 9 illustrates a flow chart of a conceptual process provided by some embodiments to position a bar catch.

FIG. 9 illustrates a flow chart of a conceptual process 900 provided by some embodiments to position a bar catch (e.g., bar catches 120-140 described above). Such a process may begin, for instance, when an exercise system is provided to a user.

As shown, the process may provide (at 910) a moveable support. Such a moveable support may be similar to the catches 120-140 described above. Next, the process may provide (at 920) a pivot locking feature on the support. Such a pivot locking feature may be similar to the pivoting hook 410 described above.

The process may then allow (at 930) the moveable support to be positioned along a vertical member of an exercise system if the pivot locking feature is in a first position. For instance, the support may be able to be moved along the vertical member (e.g., member 110) when the pivot locking feature 410 is moved away from the body 510 of the bar catch 120 such that the protuberance 870 is disengaged from through holes 880-890.

Next, the process may allow (at 940) a moveable support to be secured along a vertical member if the locking feature is in a second position. For instance, the support may be secured along the vertical member (e.g., member 110) when the pivot locking feature 410 is moved toward the body 510 of the bar catch 120 such that the protuberance 870 is engaged with through holes 880-890, thus preventing the bar catch 120 from moving along the member 110. During engagement, the shape of the protuberance 870 may lock the catch 120 in place, as gravity (as applied to the catch and/or any weight supported by the catch) forces an angled edge of the protuberance 870 to secure the body 510 of the catch 120 to the vertical member 110.

Although process 900 was described with reference to various specific details, one of ordinary skill in the art will recognize that the process may be implemented in various different ways without departing from the spirit of the invention.

While the invention has been described with reference to numerous specific details, one of ordinary skill in the art will recognize that the invention can be embodied in other specific forms without departing from the spirit of the invention. For example, several embodiments were described above by reference to particular features and/or components. However, one of ordinary skill in the art will realize that other embodiments might be implemented with other types of features and components. One of ordinary skill in the art would understand that the invention is not to be limited by the foregoing illustrative details, but rather is to be defined by the appended claims.

I claim:

1. A moveable bar catch of a weightlifting support apparatus, the bar catch comprising:

a tubular body able to be positioned along a support member of the weightlifting support apparatus, wherein the tubular body encloses a portion of the support member along a vertical axis;

a solid hook able to directly support a weightlifting bar by allowing the weightlifting bar to rest on a portion of the solid hook, the solid hook further able to pivot at a top end, allowing the solid hook to be placed in a first position which allows the tubular body to move along the support member and a second position that prevents the tubular body from moving along the support member;

a safety support element that provides protective support to the solid hook and the weightlifting bar; and a handle coupled to the tubular body, wherein the handle is coupled to a first exterior surface of the tubular body, the solid hook and the safety support are coupled to a second exterior surface of the tubular body, and the first exterior surface is opposite to the second exterior surface.

2. The moveable bar catch of claim 1, wherein the solid hook comprises a locking protuberance.

3. The moveable bar catch of claim 2, wherein the locking protuberance is disengaged from a set of through holes of the weightlifting support apparatus when in the first position.

4. The moveable bar catch of claim 3, wherein the locking protuberance is engaged with the set of through holes of the weightlifting support apparatus when in the second position.

5. The moveable bar catch of claim 4, wherein the locking protuberance comprises a surface that forms an acute angle with another surface of the moveable bar catch.

6. The bar catch of claim 4, wherein the tubular body comprises a through hole that allows the protuberance to pass through the tubular body and engage at least one hole from the set of through holes of the weightlifting support apparatus.

7. The moveable bar catch of claim 1, wherein the solid hook is coupled to the tubular body using a bolt, nut, and at least one support element.

8. The moveable bar catch of claim 7, wherein the solid hook comprises a through hole receptacle for the bolt.

* * * * *